United States Patent [19]

Biasini et al.

[11] Patent Number: 4,501,220

[45] Date of Patent: Feb. 26, 1985

[54] MUSICAL INSTRUMENT VALVE CLEANING/LUBRICATING DEVICE AND METHOD

[75] Inventors: Lino Biasini, San Jose, Calif.; Americole R. Biasini; Eivind Clausen, both of Bellingham, Wash.

[73] Assignee: Allsop, Inc., Bellingham, Wash.

[21] Appl. No.: 504,382

[22] Filed: Jun. 15, 1983

[51] Int. Cl.[3] ..... B05C 1/06; B05C 17/00; G10G 0/00

[52] U.S. Cl. ..... 118/73; 118/268; 118/72; 427/327; 427/429; 84/453; 15/104.04; 15/104.94; 401/11; 401/35

[58] Field of Search ..... 84/388, 453; 118/73, 118/203, 268; 427/444, 445, 327, 429; 15/104.04, 104.94, 105, 118, 210 B; 134/84, 85, 86, 94, 95, 6, 9; 401/35, 37, 11, 184, 196, 261

[56] References Cited

U.S. PATENT DOCUMENTS

| | | | |
|---|---|---|---|
| 791,034 | 5/1905 | Kreutzberg . | |
| 1,673,165 | 6/1928 | Sliger . | |
| 2,255,154 | 9/1941 | Esposito | 15/246 |
| 3,422,483 | 1/1969 | Craycraft | 15/210 |
| 3,635,118 | 1/1972 | Slovacek, Jr. | 84/397 |
| 3,726,173 | 4/1973 | Cortez | 84/388 |

*Primary Examiner*—Norman Morgenstern
*Assistant Examiner*—Robert J. Steinberger, Jr.
*Attorney, Agent, or Firm*—Hughes, Barnard & Cassidy

[57] ABSTRACT

A device to clean and lubricate valves of a musical instrument, such as a trumpet. There is a casing having a pair of openings, one opening having a peripheral cleaning pad, and the other a peripheral lubricating pad. The valve is selectively inserted in both openings for cleaning and lubricating.

25 Claims, 21 Drawing Figures

MUSICAL INSTRUMENT VALVE CLEANING/LUBRICATING DEVICE AND METHOD

BACKGROUND OF THE INVENTION

1. Technical Field

The present invention relates to a device and method particularly adapted to clean and lubricate valve elements of musical instruments, such as valve elements of a trumpet, and also a method of using such a device.

2. Background Art

When a person is playing a trumpet or other musical instrument having movable valve elements, it is generally necessary to remove the valve elements at reasonably frequent intervals so that they can be cleaned and lubricated. To the best knowledge of the applicants herein, the common method of accomplishing this cleaning and lubricating is a manual operation. More specifically, a handkerchief or piece of tissue is wiped over the exterior surface of the valve element to remove any contamination. Then, a lubricating oil is applied from a bottle or a dispensing can directly onto the surface of the valve element. The valve element can be rotated and moved relative to the dispensing device to attempt to distribute the lubricating oil over the entire surface. Also, after application of the lubricating oil, a tissue, piece of cloth or other object can be utilized to spread the oil over the entire valve surface.

This frequent cleaning and lubricating process is not only bothersome and time consuming, but it can sometimes be what might be called a messy operation, particularly with regard to the application of the lubricating oil. Sometimes the lubricating oil will drip from the valve on to the floor, the person's clothing, or some other object. Also, the oil may find its way onto the musician's hands.

In view of the foregoing, it is an object of the present invention to provide a cleaning/lubricating device particularly adapted to clean and lubricate an item such as a valve element of a musical instrument. It is a further object to enable the cleaning and lubricating to be accomplished in a manner to alleviate at least some of the inconveniences of the prior art manual operation of accomplishing such cleaning and lubricating.

SUMMARY OF THE INVENTION

The apparatus of the present invention comprises a cleaning device particularly adapted to clean a valve element of a musical instrument, where the valve element has a predetermined cross-sectional dimension. The device comprises a housing structure defining a first cleaning chamber and a second lubricating chamber. The housing has a first through recess extending through the first cleaning chamber and a second through recess extending through the lubricating chamber. These recesses are of a cross-sectional dimension sufficiently large to receive a valve element to be cleaned.

The cleaning chamber is particular configured to receive a cleaning pad therein, with the cleaning pad being arranged to have a through recess aligned with the first recess, in a manner that a recess defining portion of the cleaning pad being positioned to engage a valve element positioned in the first through recess of the housing.

The housing is also configured to receive a lubricating pad in the lubricating chamber, with the lubricating pad having a porous structure and being adapted to receive and retain a lubricating medium therein. With the lubricating pad installed in the chamber, the pad is formed with a through recess aligned with the second recess of the housing, with a recess defining portion of the lubricating pad being positioned to engage a valve element placed in the second recess in lubricating engagement.

Preferrably, there is a case having a configuration to define a chamber to receive the housing structure within the case. Wall means of the case thus enclose the first and second recesses of the housing. In one embodiment, the case and housing structure are arranged so that the housing structure can be slide mounted within the case, with the housing being moved outwardly from the case by sliding it along a linear path outwardly from the case.

More particularly, the housing structure has upper and lower walls, each having first edge portions defining said first through recess, and each having second edge portions defining the second through recess. The upper and lower walls are provided with inwardly directed pad engaging means adjacent the first and second edge portions, whereby the cleaning pad and the lubricating pad are held in place adjacent the first and second recess defining edge portions of the first and second walls. Desirably, the pad engaging means comprises flange members generally surrounding its related recess defining edge, with related flange members extending toward one another to compress the related pad therebetween. Desirably, at least one of the first and second through recesses is formed as a circumferentially closed opening to completely surround the valve element therein. In another configuration, at least one of the first and second recesses is formed at an edge portion of the housing as an open recess to receive a valve element.

In another embodiment, there is a case surrounding the housing structure, with the housing structure being rotatably mounted in the case. The case is formed with opening means matching the first and second recesses. The case and the housing are rotatable in a manner that the opening means of the case can be placed in alignment with recesses of the housing so that the valve elements can be cleaned in said recesses, and the case and housing can be rotated to a closed position where the opening means in the case are out of alignment with the recesses.

In one arrangement, the case is made up of two case sections rotatable with one another. The two case sections can be rotated relative to one another to bring the opening means out of alignment with the recesses of the housing structure. In a particular configuration, there is cooperating drive means between the case sections to cause relative rotation of the housing structure relative to the case sections when the two case sections are moved relative to one another.

In a modification of the above embodiment, the case is a unitary structure, and the housing is rotated relative to the case to bring the opening means of the case into and out of alignment with the first and second recesses of the housing.

In a preferred form, the housing has peripheral side wall means defining a lubricating chamber. This is arranged so that the lubricating pad is located in the lubricating chamber with the side portions of lubricating pad being spaced from the side wall means of the housing to form a peripheral gap. This lubricating fluid can better be retained in the lubricating pad without leaking out through the housing.

In a more specific configuration, at least one of the cleaning pad and lubricating pad (and more desirably, both pads) has an edge pad portion adjacent its related recess, with such portion extending beyond related recess defining edge portions of the upper and lower walls of the housing structure. This insures engagement of said one of the pads with a valve element. An improvement is that such pad edge portion is provided with radially extending slots to permit deflection of the pad edge portion to enhance its wiping action against the valve element.

In the method of the present invention, an apparatus is provided in accordance with one of the embodiments or modifications noted above. A valve element is cleaned by first inserting it through the cleaning recess so as to remove contamination from the valve element. Then, the valve element is inserted through the lubricating recess to have a lubricating medium applied thereto. Thereafter, the housing structure defining the cleaning and lubricating recesses can be reinserted in a case so as to be in a stowed position and close the cleaning and lubricating recesses.

Other features of the present invention will become apparent from the following detailed description.

DESCRIPTION OF THE PREFERRED EMBODIMENTS

Figure 1:
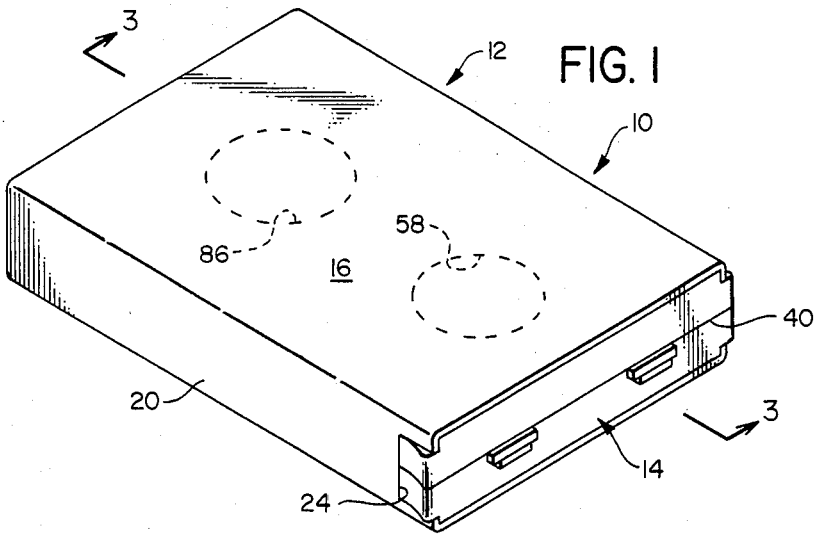
FIG. 1 is an isometric view of a first embodiment of the present invention in its stowed position.

In the first embodiment 10 shown in FIGS. 1–5, there is an outer case 12 having a general box-like rectangular configuration, in which is removably positioned a housing structure 14. The case 12 has top and bottom walls 16 and 18, respectively, two side walls 20, and a rear wall 22. The front of the case 12 is open, and the front end of the two side walls 20 are formed with small recesses 24 to permit the forward end of the case 12 to be manually grasped when it is in the housing structure 14.

The housing structure 14 has the same rectangular box-like configuration as the case 12 and is dimensioned so that it will slide snuggly into and from the case 12. Accordingly, the housing structure 14 has top and bottom walls 26 and 28, respectively, two side walls 30, a rear wall 32, and a front wall 34. The two forward side portions of the housing 14 are flared outwardly to a moderate extent at 36 to provide convenient thumb and finger grips for removal of the structure 14 from the case 12.

Figure 4:
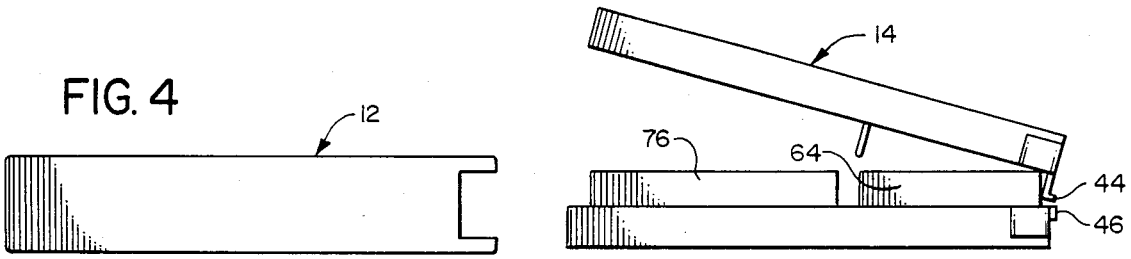
FIG. 4 is a side elevational view showing the housing removed from its case, and the lid of the housing being opened.
Figure 5:
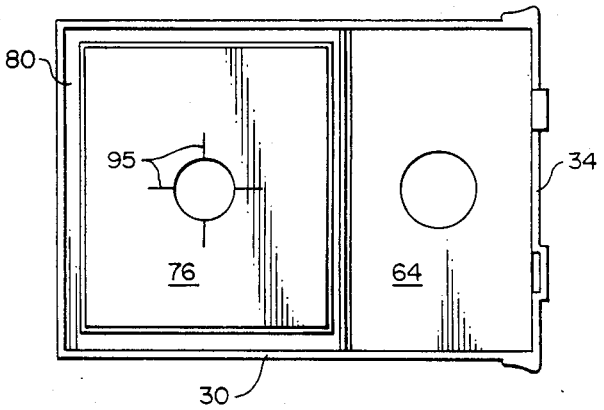
FIG. 5 is a top plan view of the housing of FIG. 4, with the lid of the housing removed.

The housing structure 14 is made in the form of substantially identical upper and lower housing sections **38*a* and 38*b*, which meet at a seam or juncture line 40 extending around the side periphery of the housing 14. To latch the two sections 38*a* and 38*b* together, the front wall portion of each section has on one side a downwardly (or upwardly) tongue or finger 42 which has at its end a catch 44. This catch 44 is adapted to engage a slotted retaining member 46 formed at the front end of the other housing section 38*a* or 38*b*. On each housing section 38*a* or 38*b*, the tongue 42 and slotted retaining member 46 are positioned on opposite sides of the front wall 34 and equally distant from the side edge of the front wall 34. Thus, when one housing section 38*a* or 38*b* is inverted and placed on the other, the tongue 42 of one section 38*a* or 38*b* comes into engaging relationship with the slotted retaining member 46 of the other. As illustrated in FIG. 4, when the housing structure 14 is removed from the case 12, the upper section 38*a* can be tilted upwardly about the hinge mounting provided by the tongue 42 and retaining member 46. These members 42 and 46** are made of a moderately yielding material to permit such upward hinge action.

The housing structure 14 is partitioned by a middle wall 48 into a forward cleaning chamber 50 and a rear lubricating chamber 52. This wall 48 is conveniently made of two wall sections 54 and 56 secured to the upper and lower housing sections **38*a* and 38*b***, respectively.

The upper and lower housing walls 26 and 28 are formed with aligned upper and lower circular openings 58 and 60, respectively. The diameter of these two openings 58 and 60 (indicated at "a") is moderately larger than the diameter of the valve element which is to be cleaned, such a valve element being indicated at 62 in FIG. 2. Located within the cleaning chamber 50 is a cleaning element which is a block or pad 64 of reticulated felted foam. This foam pad 64 has the same overall configuration as the cleaning chamber 50, and is formed with a center through opening 66 that is aligned with the two openings 58 and 60. However, the opening 66 has a diameter (indicated at "b") slightly smaller than that of the valve element which is to be cleaned.

Desirably, the diameter of the cleaning pad opening 66 would be approximately 1/16 of an inch less than the diameter of the valve element 62. Thus, if the diameter of the valve element is approximate 11/16 inch, the diameter of the opening would be about 10/16 inch. For these same dimensions, the diameter of the wall openings 58 and 60 would be about 14/16 inch, which would be about 3/16 inch larger than the diameter of the valve element 62.

Surrounding the upper wall opening 58 and spaced radially outwardly therefrom a short distance is a downwardly extending circular lip 68. The lower wall 56 is formed with a similar circular lip 70 positioned around the lower opening 60. These two lips 68 and 70 grip the cleaning pad 64 so as to accomplish two functions. First, by gripping the pad 64, the lips 68 and 70 hold the pad 64 in place and prevent it from being pulled outwardly from the upper or lower openings 58 and 60. Second, by compressing the portion of the pad 64 adjacent the openings 58 and 60, the lips 68 and 70 tend to space the pad 64 just slightly from the edges of the openings 58 and 60 to prevent the pad 64 from being wedged against the edges of the openings 58 and 60 during the valve cleaning operation.

There is a lubricating element or pad 76 positioned within the lubricating chamber 52. This lubricating pad 76 is also made of a reticulated felted foam material, and it has generally the same configuration as the lubricating chamber 52 so as to substantially fill that chamber 52. However, the peripheral edge portions 78 of the pad 76 are spaced inwardly from the side walls 30, rear wall 32 and partition wall 48, so as to leave a peripheral gap or slot 80. The reason for this is that when the lubricating pad 26 is wetted with a lubricating oil, there is a tendency for the lubricating oil to possibly leak outwardly through the circumferential seam or juncture line 40 of the two housing sections 38*a* and *b*. By spacing the periphery of the lubricating pad 76 inwardly a short distance, this tendency to leak can be substantially eliminated. To properly position the lubricating 76 centrally within the lubricating chamber 52, there is provided small upstanding lips 82 and 84 on the top and bottom walls 26 and 28, and lubricating pad 76 fits within such lips 82 and 84.

The upper and lower walls 26 and 28 are formed with aligned circular openings 86 and 88, respectively, which are centrally positioned relative to the lubricating chamber 52. Also, the lubricating pad 76 is formed with an aligned center opening 90. Since these openings 86, 88 and 90 are formed in substantially the same manner as corresponding openings 58, 60 and 66, these will not be described in anymore detail herein. Also, as with the cleaning chamber 50, the lubricating chamber 52 has the upper and lower flanges 92 and 94 surrounding openings 86 and 88, respectively, to hold the lubricating pad 76 properly in place.

The diameter of the opening 90 of the lubricating pad 76 is indicated at "c", and is desirably about $\frac{1}{4}$ of an inch, with the diameter of the openings at 86 and 88 being about $\frac{7}{8}$ of an inch. The portion of the pad 76 which extends inwardly beyond the openings 86 and 88 is formed with a plurality of radial slots 95 to better permit this inner pad portion to deflect when the valve element 62 is inserted through the opening 90.

To describe the operation of this first embodiment, the housing structure 14 is generally carried within the case 12, with the case 12 closing the cleaning openings 58 and 60 and the lubricating openings 86 and 88. Normally, the lubricating pad 76 has a lubricating oil applied thereto, with the lubricating oil being absorbed in the foam structure of the lubricating pad 76. The cleaning pad 64 can be used either as a dry pad, or it may have a cleaning solution absorbed into the pad 64, depending upon the precise application and the preferences of the user. To apply the lubricating oil to the pad 76, the housing 14 is removed from the case 12, as shown in FIG. 4, the top section 38*a* moved upwardly, and the lubricating oil applied directly to the lubricating pad 76. In like manner, if a cleaning solution is utilized, it could be applied directly to the cleaning pad 64 in the same manner.

Figure 2:
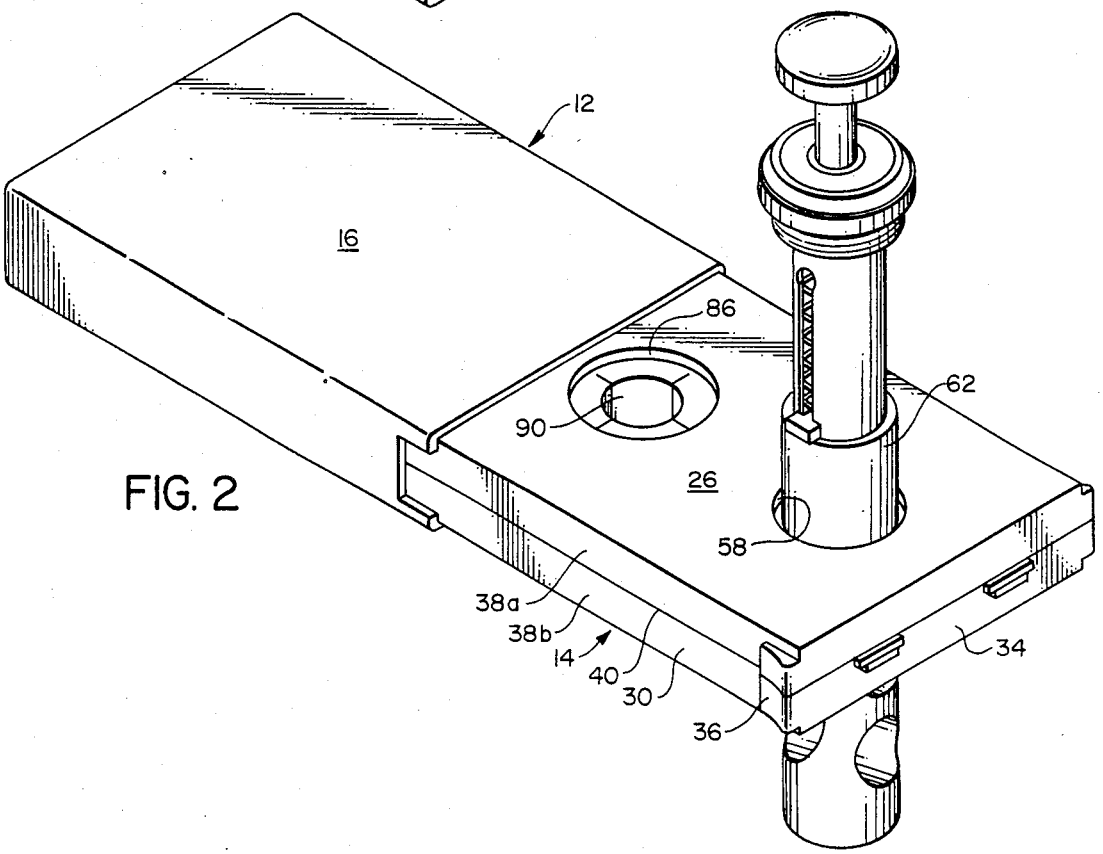
FIG. 2 is a view similar to FIG. 1, but showing the first embodiment in its operating position, with a valve element being cleaned and lubricated by the device.

To clean and lubricate the valve element, the housing 14 is pulled from the case 12 as shown in FIG. 2, and the valve element 62 is moved downwardly through the aligned openings 58, 60 and 66, and then reciprocated vertically a number of times. The contaminated lubricating oil or other contamination on the valve element 62 is removed by the action of the pad 64.

Then, the valve element 62 is moved to a location above the opening 86 and then moved downwardly through the aligned lubricating openings 86, 88 and 90, so that the lubricating oil on the pad 76 is deposited on the surface of the valve element 62. The valve can be moved up and down several times to insure proper application of the oil. With this cleaning and lubricating completed, the valve element 62 can be replaced in the musical instrument, and the housing 14 inserted back within the case 12.

Also, the pads 64 and 76 are easily removed by opening the housing 14 as illustrated in FIG. 4 and lifting the pads 64 and 76 from the lower housing section 38*b*. After removal, the pads 64 and 76 can be cleaned or possibly replaced with other pads.

The second embodiment of the present invention is shown in FIGS. 6–11. This second embodiment is generally designated 100, and it comprises upper and lower generally circular case sections 102 and 104, respectively, rotatably mounted relative to one another. The upper case section 102 has a pair of openings 106 and 108 (corresponding to openings 58 and 60 of the first embodiment), positioned diametrically opposite one another. The lower housing section 104 also has a pair of openings 110 and 112, also positioned diametrically opposite one another at locations corresponding to the upper openings 106 and 108.

Positioned within the two case sections 102 and 104 is a circular housing member 114. This housing member 114 has upper and lower openings corresponding to the aforementioned openings 106–112. The openings in the housing 114 are given numerical designations corresponding to those of openings 106 and 112, with an "a" suffix distinguishing those openings which are in the inner housing member 114.

The inner housing 114 is partitioned into a cleaning chamber and a lubricating chamber 116 and 118, respectively, containing a cleaning pad 120, with an opening 121 and a lubricating pad 122, with an opening 123. Since the placement of the pads 120 and 122 in the chambers 116 and 118 is functionally substantially the same as in the previously described embodiment, this will not be described in detail herein. However, the mechanism by which the openings are closed is somewhat different in this second embodiment.

Figure 6:
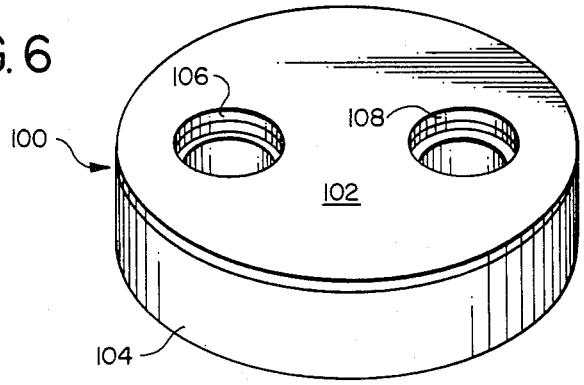
FIG. 6 is an isometric view of a second embodiment of the present invention.
Figure 7:
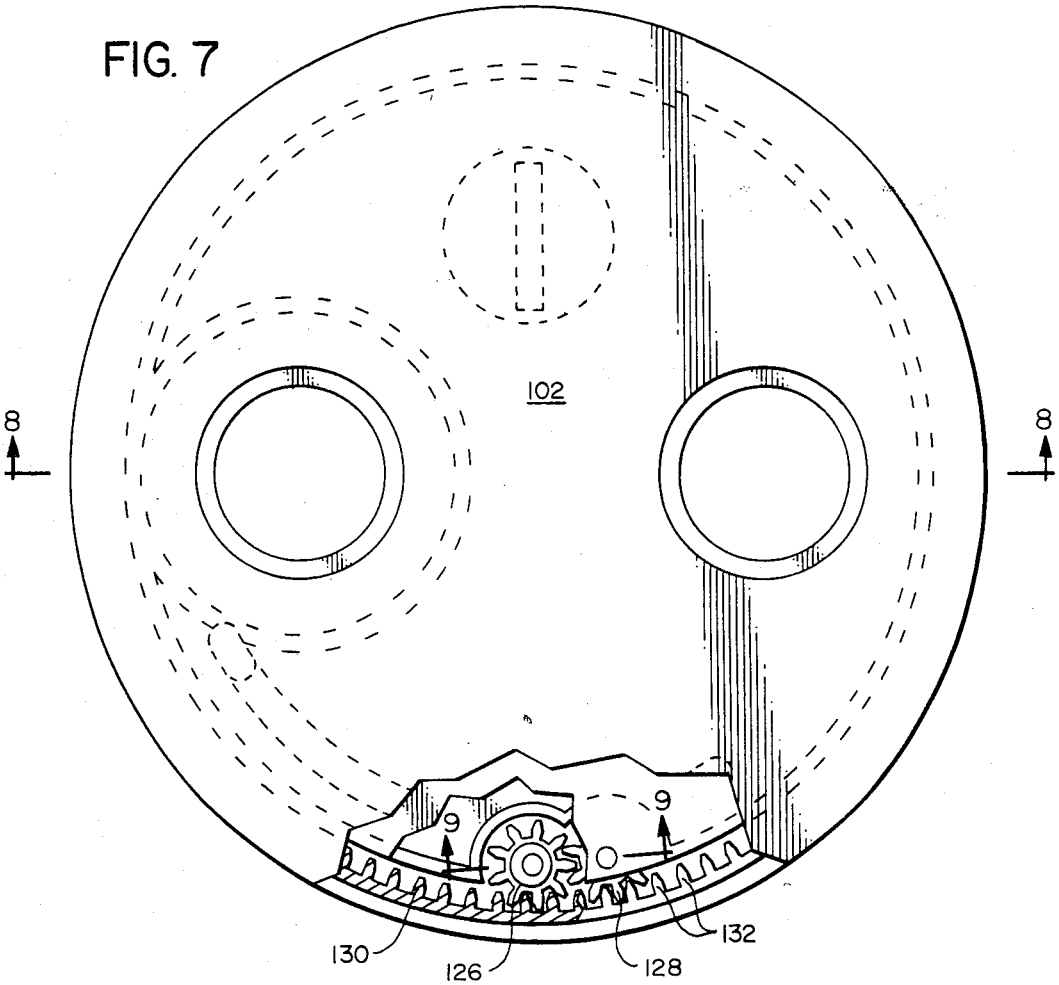
FIG. 7 is a top plan view of the embodiment of FIG. 6, with portions of the lid being broken away for purposes of illustration.
Figure 8:
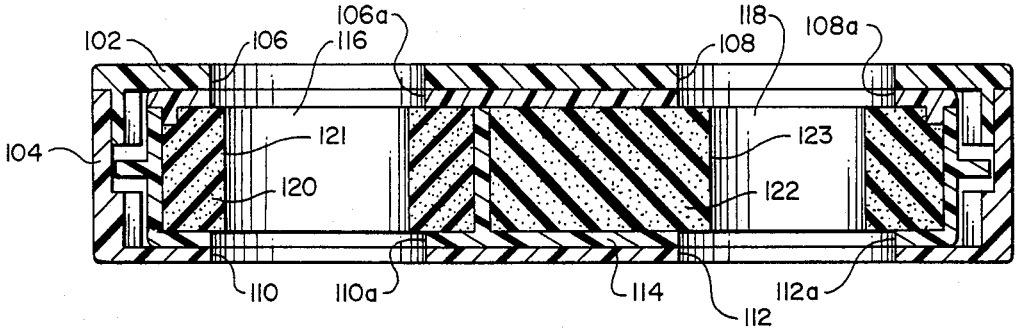
FIG. 8 is a sectional view taken along line 8—8 of FIG. 7.
Figure 9:
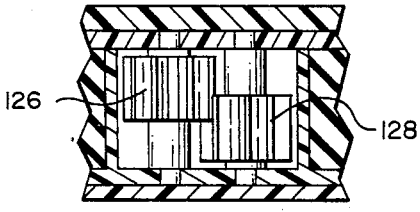
FIG. 9 is a sectional view taken at line 9—9 of FIG. 7 and showing the cooperating drive elements of the second embodiment.
Figure 10:
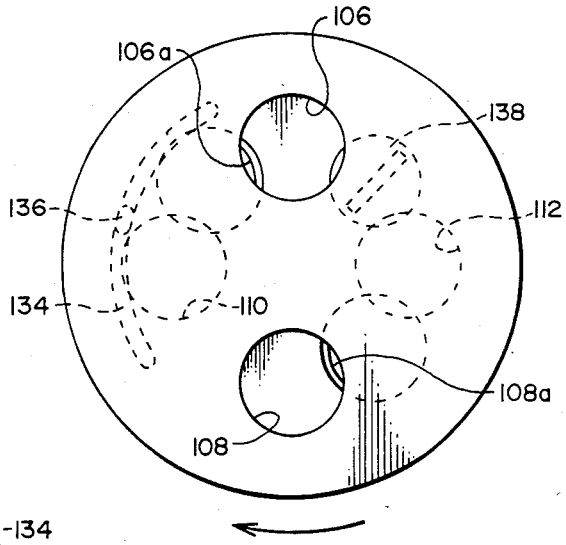
FIG. 10 is a top plan view of the second embodiment, half way between its stowed and operating position.
Figure 11:
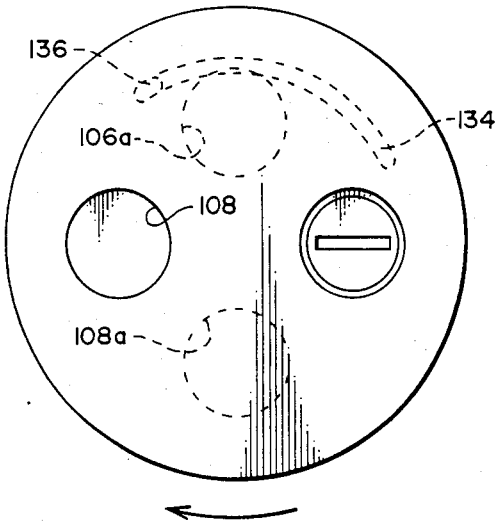
FIG. 11 is a top plan view similar to FIG. 10, showing the second embodiment in its stowed position.

In the operating position, the openings 106–112 are aligned with their related openings **106*a*–112*a*, and this arrangement is shown in FIG. 8, and also in FIG. 6. In this position, the valve element 62 can be moved through the cleaning opening and the lubricating opening as in the previous embodiment. When it is desired to move the device to its closed position, the upper and lower housing sections 102 and 104 are rotated oppositely to one another. This causes the upper openings 106 and 108 to move out of alignment with the lower openings 110 and 112. Also, this causes the corresponding openings 106*a*–112*a* to move out of alignment with the corresponding openings 106–112**.

This particular closing operation is accomplished by providing the housing section 104 with a pair of pinion gears 126 and 128 which are mounted at the periphery of the housing 104 and engage one another. The gear 126 is positioned at a higher location so as to engage matching gear teeth 130 formed at the inner peripheral edge of the upper housing section 102. The lower gear 128 engages gear teeth 132 formed in the lower housing section 103.

When the upper and lower housing sections 102 and 103 are rotated oppositely to one another, the two gears 126 and 128 are caused to rotate in opposite directions. This causes the inner housing section 114 to rotate relative to both the upper and lower housing sections 102 and 104 at a relative rotational speed one-half that at which the upper and lower housings 102 and 104 rotate relative one to another. This can be seen in FIG. 10, where the housing sections 102 and 104 have been moved half way to the closed position. It will be noted that the upper openings 106 and 108 have moved totally out of alignment with the openings 110 and 112. On the other hand, the opening **106*a* and 108*a* of the inner housing section 104 have not yet moved completely out of alignment with the openings 106 and 108. As rotation is continued to the position in FIG. 11, the inner openings of the housing 104 are completed closed off. To limit the rotation beteen the housing sections 102 and 103, there is provided a cooperating stop means, comprising a arcuate 90° slot 134 and a stop member 136**.

Also, the upper wall of the inner housing 114 is provided with an access opening closed by a closure member 138. By rotating the sections 102 and 103 to a location where the member 138 is aligned with the slot 106, the closure member 138 can be removed, and a lubricating oil inserted through the access opening and onto the lubricating pad 122. This enables the lubricating oil to be applied without disassembling the device.

Figure 12:
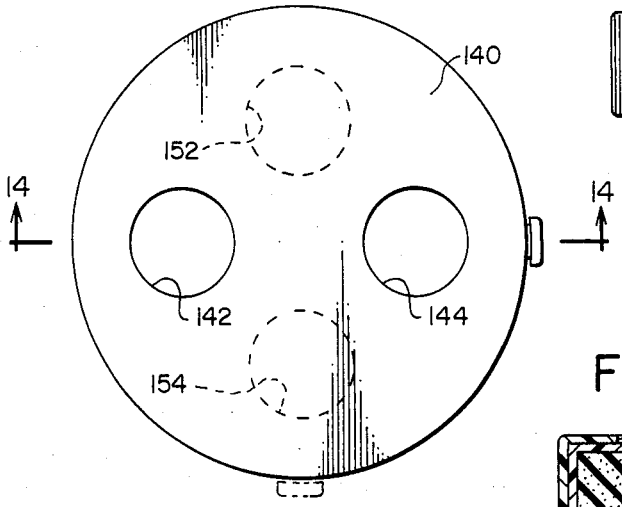
FIG. 12 is a top plan view of a modified form of the embodiment shown in FIGS. 6–11.
Figure 13:
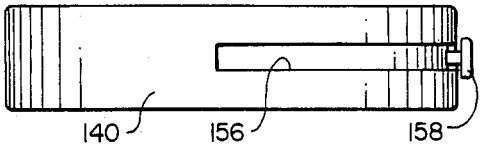
FIG. 13 is a side elevational view of the modification shown in FIG. 12.
Figure 14:
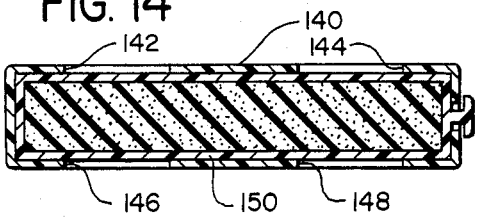
FIG. 14 is a sectional view taken along line 14—14 of FIG. 12.

A modification of the second embodiment is shown in FIGS. 12–14. In this embodiment, there is shown an outer case 140 which is made as a unitary member. While the case 140 can be made in two sections for assembly, the case 140 essentially functions as a unitary structure. The case 140 has upper and lower aligned openings 142–148. There is an inner circular housing 150 having a circular configuration and fitting within the case 140. This inner housing 150 is constructed in generally the same configuration as the aforementioned inner housing 104 of the second embodiment, so this will not be described in detail herein. Rather, it will be indicated that this housing 150 has two sets of openings 152 and 154.

The case 140 has an arcuate slot 156 formed along 90° of its circumference. The inner housing 150 has a manipulating knob 158 connected thereto and extending outwardly through the slot 156. By moving this knob 158 from end of the slot 156 to the other, the openings 142–148 can be brought into and out of alignment with the corresponding openings 152 and 154 of the inner housing 150. In other respects, the mode of operation of this modification shown in FIGS. 12–14 is substantially the same as with the previous embodiments.

A third embodiment of the present invention is shown in FIGS. 15–20, this third embodiment being generally designated 170. There is an outer case 172 having a general box-like configuration, and having a open front 174.

There is an inner housing 176 having generally the same box-like rectangular configuration as the case 172 and being slide mounted for movement into and from the case 172. This housing 176 is made in upper and lower sections 178 and 180 and these sections 178 and 180 are formed with longitudinally extending partition walls 182 to form right and left chambers, namely a right cleaning chamber 184 and a left lubricating chamber 186. The right edge of the housing 176 is formed with a semi-circular forward cut out 188 and a semi-circular rear cut out 190. A cleaning pad 192 is positioned within the cleaning chamber 184, and it is formed with matching cut outs **188*a* and 190*a*, these cut outs being of a slightly smaller diameter than the housing cut outs 188 and 190**, respectively.

In like manner, the left side of the housing 176 is formed with a pair of cut outs, namely a forward semi-circular cut out 194 and a rear semi-circular cut out 196. A lubricating pad 198 positioned within the lubricating chamber 186 is formed with matching cut outs **194*a* and 196*a*, the diameter of these cut outs 194*a* and 196*a* being moderately smaller than corresponding cut outs 194 and 196. Each of the housing cut outs 188, 190, 194 and 196 has a semi-circular lip 200 surrounding the related cut out, to hold the related pad 192 or 198** in the appropriate position relative to the related cut out.

Figure 15:
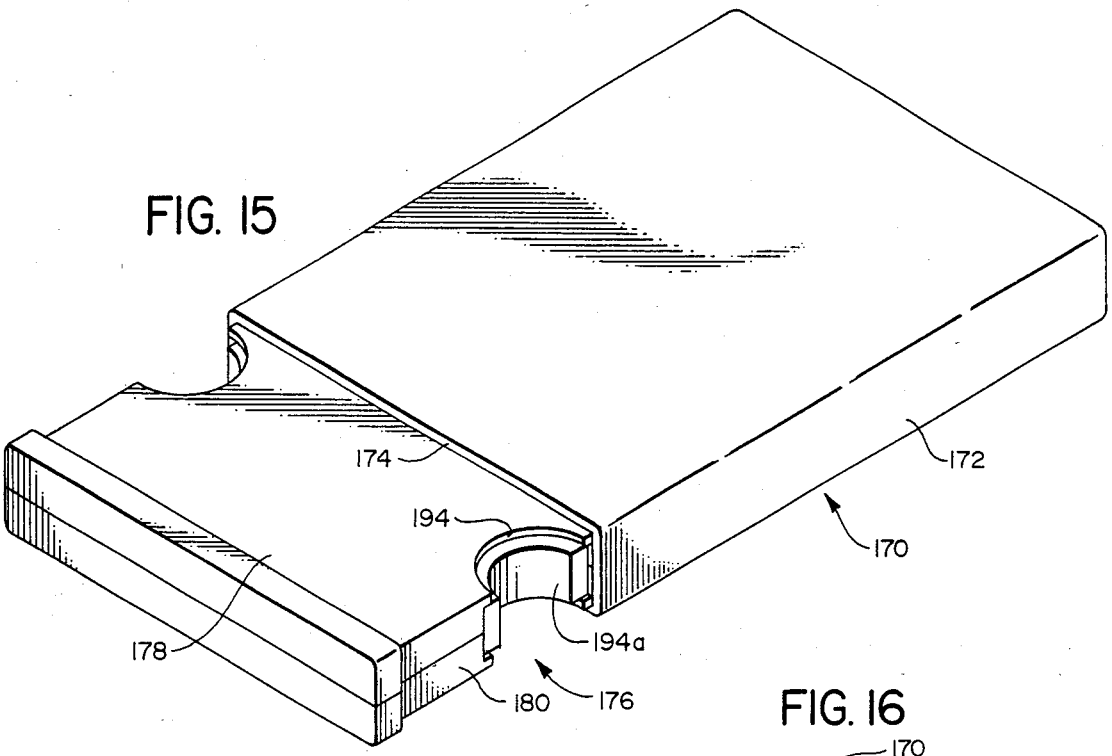
FIG. 15 is an isometric view of a second embodiment of the present invention, shown in one operating position.
Figure 16:
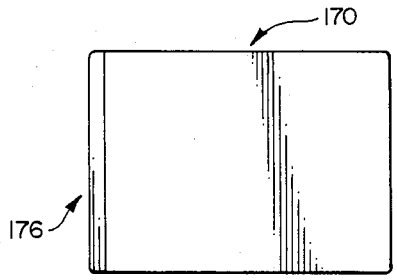
FIG. 16 is a top plan view of the embodiment of FIG. 15, completely in its stowed position.
Figure 17:
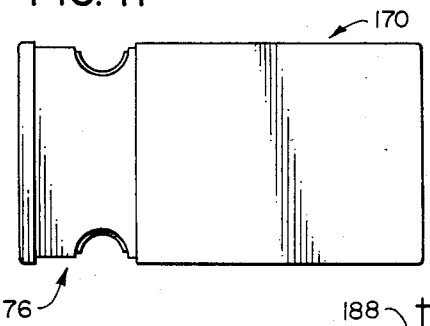
FIG. 17 is a top plan view of the embodiment of FIG. 15, shown in the position of FIG. 15.
Figure 18:
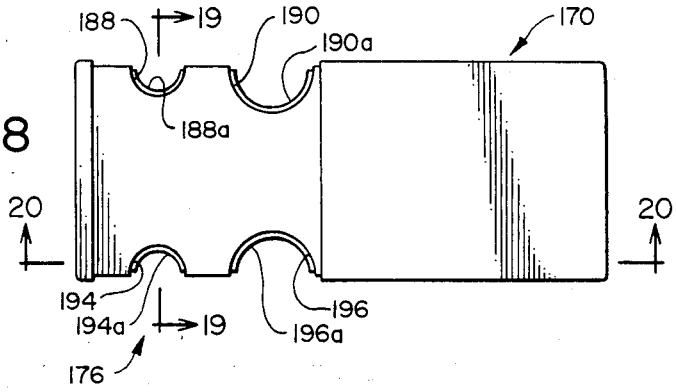
FIG. 18 is a top plan view similar to FIG. 17, showing the third embodiment in a second operating position.
Figure 19:
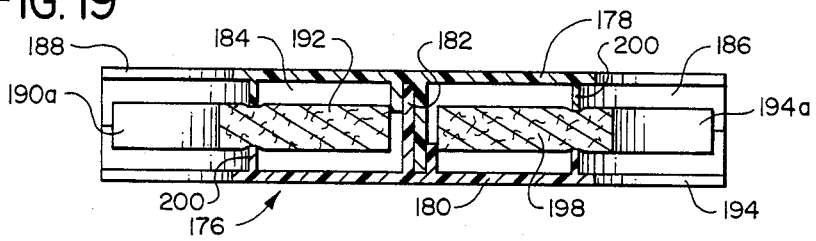
FIG. 19 is a sectional view taken along line 19—19 of FIG. 18.
Figure 20:
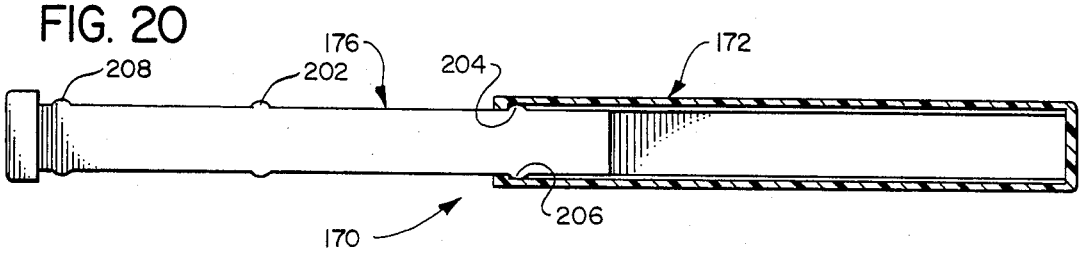
FIG. 20 is a sectional view taken along line 20—20 of FIG. 18.

The general mode of operation of this third embodiment is generally similar to that of the first embodiment. In the stowed position, the housing 176 is inserted fully into the case 172, as shown in FIG. 16. To clean and lubricate the valve elements of a musical instrument, the housing 176 is pulled out of the case 172, as indicated in FIG. 15, thus exposing the two forward cut outs 188 and 194. The valve element can then be cleaned against the cleaning pad portion adjacent the cut out 188, and then lubricated by applying it against the lubricating pad portion adjacent the cut out 194.

It will be noted that the rear cut outs 190 and 196 are made with a moderately larger arcuate section. This is to accommodate valve elements of a larger diameter.

To properly position the housing 176 in either of two selected positions (i.e. the partially extracted position of FIG. 15, and the further extracted position of FIG. 18), the housing can be provided with upper and lower protrusions, namely a forward set of protrusions 202 and a rear set of protrusions 204. These can fit into matching detents 206 at the forward inner surface of the case 172. The protrusion at 208 is engaged when the housing is fully stowed in the case 172.

Figure 3:
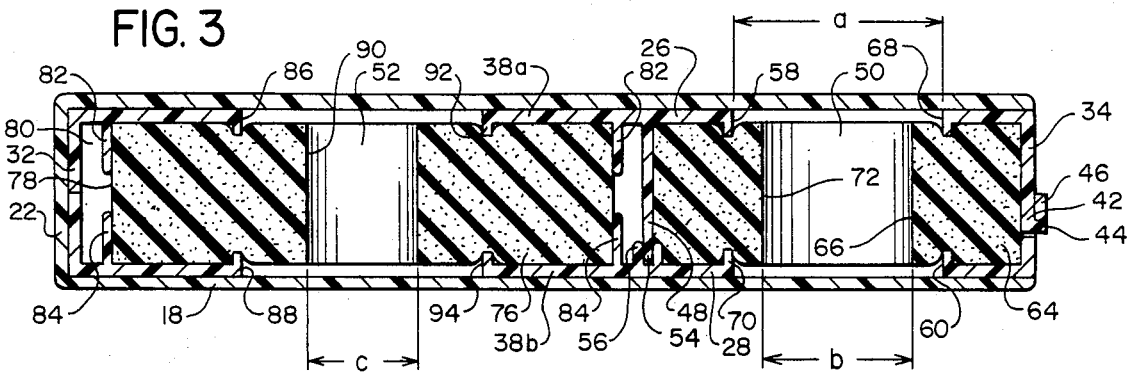
FIG. 3 is a sectional view taken along line 3—3 of FIG. 1.
Figure 21:
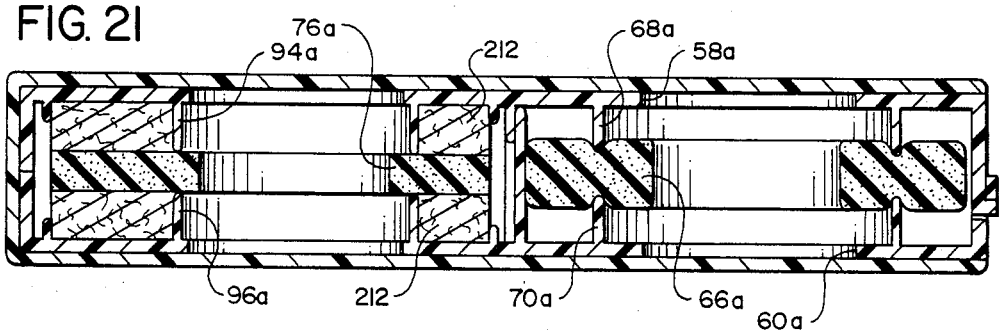
FIG. 21 is a sectional view similar to FIG. 3, showing a modified arrangement for the pads.

A modified arrangement is shown in FIG. 21, and this is substantially similar to the arrangement shown in FIG. 3. Accordingly, components of the modification in FIG. 21 are given numerical designations similar to components of FIG. 3, with an "a" suffix as distinguishing those of the modification of FIG. 23. With regard to the pad 66*a*, the flange members 68*a* and 70*a* are spaced inwardly from the edges of the openings 58*a* and 60*a*, and protrude further inwardly so as to space the pad 66*a* away from the edges of the openings 58*a* and 60*a*. The flanges 94*a* and 96*a* which hold the lubricating pad are likewise spaced somewhat inwardly from corresponding opening edge openings and extended. The lubricating pad 76*a* is made substantially thinner, and this is sandwhiched between fibrous felt members 212 which are well adapted to hold the lubricating oil. Thus, the inner pad portion 76*a* which is softer and better adapted to engage the valve element 62 can derive lubricating oil from the felt pad portion 212.

The above embodiments are presented to illustrate preferred configurations of the present invention, and it is to be understood that various modifications could be made without departing from the basic teachings of the present invention,. Further, including tne application of cleaning valve elements such as in a trumpet, the device of the present invention can conveniently be used to clean the slide of trombones which are also subject to contamination.

We claim:

1. A cleaning device particularly adapted to clean a valve element of a musical instrument, where the valve element has a predetermined cross-sectional dimension, said device comprising:

(a) a housing structure defining a first cleaning chamber and a second lubricating chamber;

(b) said housing having a first through recess extending through said first cleaning chamber and a second through recess extending through said second lubricating chamber, said recesses being of a cross-sectional dimension sufficiently large to receive a valve element to be cleaned;

(c) a cleaning pad mounted in said cleaning chamber and having a through recess aligned with the first recess, with a recess defining portion of said cleaning pad being positioned to engage a valve element positioned in the first through recess of the housing;

(d) a lubricating pad mounted in said lubricating chamber, said lubricating pad having a porous structure and being adapted to receive and retain a lubricating medium therein, said lubricating pad being formed with a through recess aligned with said second recess, with a recess defining portion of the lubricating pad being positioned to engage a valve element placed in said second recess in lubricating engagement.

2. The device as recited in claim 1, further comprising a case having a configuration to define a chamber to receive the housing structure within the case, with wall means of the case enclosing the first and second recesses of the housing.

3. The device as recited in claim 2, wherein said case and said housing structure are arranged so that said housing structure can be slide mounted within said case, with said housing being moved outwardly from said case by sliding it along a linear path outwardly from said case.

4. The device as recited in claim 3, wherein said housing has upper and lower walls, each having first edge portions defining said first through recess, and each having second edge portions defining said second through recess, and upper and lower walls being provided with inwardly directed pad engaging means adjacent said first and second edge portions, whereby said cleaning pad and said lubricating pad are held in place adjacent said first and second recess defining edge portions of the first and second walls.

5. The device as recited in claim 4, wherein said pad engaging means comprises flange members generally surrounding its related recess defining edge, with related flange members extending toward one another to compress the related pad therebetween.

6. The device as recited in claim 5, wherein at least one of said first and second through recesses is formed as a circumferentially closed opening to completely surround a valve element inserted therein.

7. The device as recited in claim 5, wherein at least one of said first and second recesses is formed at an edge portion of said housing as an open recess to receive a valve element.

8. The device as recited in claim 1, wherein there is a case surrounding said housing structure, and said housing structure is rotatably mounted in said case, said case being formed with opening means matching said first and second recesses, said case and said housing being rotatable in a manner that the opening means of the case can be placed in alignment with the recess of the housing so that valve elements can be cleaned in said recesses, and said case and housing can be rotated to a closed position where the opening means of the case are out of alignment with the recesses.

9. The device as recited in claim 8, wherein said case is made up of two case sections rotatable with one another, and said two case sections can be rotated relative to one another to bring the opening means out of alignment with the recesses of the housing structure.

10. The device as recited in claim 9, wherein said case sections and said housing structure are provided with cooperating drive means to cause relative rotation of the housing structure relative to the two case sections when the two case sections are moved relative to one another.

11. The device as recited in claim 8, wherein said case is a unitary structure, and said housing is rotated relative to said case to bring the opening means of the case into and out of alignment with the first and second recesses of the housing.

12. The device as recited in claim 1, wherein said housing has peripheral side wall means defining said lubricating chamber, said lubricating pad being located in said lubricating chamber with side portions of the lubricating pad being spaced from said side wall means of the housing to form a peripheral gap, whereby lubricating fluid can better be retained in said lubricating pad without leaking out through said housing.

13. The device as recited in claim 12, wherein said housing has locating means to properly position said lubricating pad in said lubricating chamber so as to insure proper spacing of said pad relative to side wall means of said housing structure.

14. The device as recited in claim 1, wherein at least one of said cleaning pad and said lubricating pad has an edge pad portion adjacent its related recess, said edge pad portion extending beyond a related recess defining edge portion of upper and lower walls of said housing structure, to insure engagement of said one of said pads with a valve element.

15. The device as recited in claim 14, wherein said pad edge portion is provided with radially extending slots to permit deflection of the pad edge portion to enhance its wiping action against a valve element.

16. A cleaning device particularly adapted to clean a valve element of a musical instrument, where the valve element as a predetermined cross-sectional dimension, said device comprising:

(a) a housing structure defining a first cleaning chamber and a second lubricating chamber;

(b) said housing structure having a first through recess extending through said first cleaning chamber and a second through recess extending through said second lubricating chamber, said recesses being of a cross-sectional dimension sufficiently large to receive a valve element to be cleaned;

(c) said housing structure being configured to position a cleaning pad in said cleaning chamber where a through recess of said cleaning pad can be aligned with the first recess so that a recess defining portion of said cleaning pad can be positioned to engage a valve element positioned in the first through recess of the housing;

(d) said housing structure being configured to position a porous lubricating pad in said lubricating chamber to receive and retain a lubricating medium therein so that a through recess of said lubricating pad can be aligned with said second recess, and so that a recess defining portion of the lubricating pad can be positioned to engage a valve element placed in said second recess in lubricating engagement.

17. The device as recited in claim 16, further comprising a case having a configuration to define a chamber to receive the housing structure within the case, with wall means of the case enclosing the first and second recesses of the housing.

18. The device as recited in claim 17, wherein said case and said housing structure are arranged so that said housing structure can be slide mounted within said case, with said housing being moved outwardly from said case by sliding it along a linear path outwardly from said case.

19. The device as recited in claim 16, wherein said housing has upper and lower walls, each having first edge portions defining said first through recess, and each having second edge portions defining said second through recess, said upper and lower walls being provided with inwardly directed pad engaging means adjacent said first and second edge portions, whereby a cleaning pad and a lubricating pad can be held in place adjacent said first and second recess defining edge portions of the first and second walls.

20. The device as recited in claim 19, wherein said pad engaging means comprises flange members generally surrounding its related recess defining edge, with related flange members extending toward one another to compress the related pad therebetween.

21. The device as recited in claim 16, wherein at least one of said first and second through recesses is formed as a circumferentially closed opening to completely surround a valve element inserted therein.

22. The device as recited in claim 16, wherein at least one of said first and second recesses is formed at an edge portion of said housing as an open recess to receive a valve element.

23. The device as recited in claim 16, wherein there is a case surrounding said housing structure, and said housing structure is rotatably mounted in said case, said case being formed with opening means matching said first and second recesses, said case and said housing being rotatable in a manner that the opening means of the case can be placed in alignment with the recesses of the housing so that valve elements can be cleaned in said recesses, and said case and housing can be rotated to a closed position where the opening means of the case are out of alignment with the recesses.

24. The device as recited in claim 16, wherein said housing structure has peripheral side wall means defining said lubricating chamber and is arranged to locate a lubricating pad in said lubricating chamber with side portions of the lubricating pad being spaced from said side wall means of the housing to form a peripheral gap, whereby lubricating fluid can better be retained in said lubricating pad without leaking out through said housing.

25. The device as recited in claim 24, wherein said housing has locating means to properly position a lubricating pad in said lubricating chamber so as to insure proper spacing of said pad relative to side wall means of said housing structure.

* * * * *